US006035467A

United States Patent [19]

Lee

[11] Patent Number: 6,035,467

[45] Date of Patent: Mar. 14, 2000

[54] ONE-PIECE COMPACT FOLDING BED

[76] Inventor: Hsueh Yen Lee, 3F No. 13-1 Ka Chang Rd., Shih Lin, Taipei, Taiwan

[21] Appl. No.: 09/204,411

[22] Filed: Dec. 2, 1998

[51] Int. Cl.[7] ..... A44C 17/02

[52] U.S. Cl. ..... 5/174; 5/305; 5/306

[58] Field of Search ..... 5/174, 111, 115, 5/199, 249, 250, 226, 227, 305, 306, 424, 509.1, 510, 662, 112, 627

[56] References Cited

U.S. PATENT DOCUMENTS

| | | | |
|---|---|---|---|
| 589,482 | 9/1897 | Rimmelin | 5/117 |
| 607,607 | 7/1898 | Rimmelin | 5/117 |
| 765,369 | 7/1904 | Smith et al. | 5/627 |
| 3,550,168 | 12/1970 | Woodford . | |
| 3,602,926 | 9/1971 | Marini | 5/111 |
| 5,335,385 | 8/1994 | Brown | 5/662 |
| 5,386,601 | 2/1995 | Kohl . | |

*Primary Examiner*—Michael F. Trettel
*Assistant Examiner*—Fredrick Conley
*Attorney, Agent, or Firm*—Maria Erlinda C. Sarno

[57] ABSTRACT

A compact folding bed having a symmetry plane comprising a pair of symmetrical frames wherein each base support element is covered with filling materials and enveloped within a fabric or leather casing to also form the mattress of the folding bed. The folding bed fold outward with each frame joined together by a pivoting bracket connected to a flanged end portion of the middle leg of the folding frame. The bed is held at the unfolded position for use by clip wires and tension springs. One support structure attached to a lateral end of one frame serve both as a head board and a leg while a second support structure serve both as a foot board and another leg.

19 Claims, 4 Drawing Sheets

ONE-PIECE COMPACT FOLDING BED

BACKGROUND

This invention relates to a compact, one-piece, folding bed. The bed comprise of two substantially rectangular frames linked together by brackets and spring, the bracket connections allowing the frames to easily fold and unfold. The rectangular frames forming the bed are covered with filling material and enveloped within a fabric or leather material, thereby integrating the bed frame and mattress into one element. Conventional folding beds usually have detachable mattresses which are bulky and harbor dirt during storage. Further, the mainframe is usually exposed to environmental conditions which causes it to eventually become rusty.

It is therefore an object of this invention to provide a folding bed having an upholstered main frame thereby avoiding the need of a separate mattress.

It is also an object of this invention to provide a one-piece compact folding bed that is easily transported and stored when not in use.

It is a further object of this invention to provide a folding bed employing simple mechanical means of assembly.

Other objects, features and advantages of the invention will become apparent as the description thereof proceeds when considered in connection with the accompanying illustrative drawings.

SUMMARY OF THE INVENTION

This invention relates to a one-piece folding bed having a symmetry plane comprising a pair of symmetrical frames, each frame having two longitudinal sides, two lateral sides, a mid lateral side and an outside lateral side, a top surface, an underside, a base support element, the pair of symmetrical frames covered with filling material encased in fabric or leather material forming a mattress; pivoting brackets located at the opposite ends of the mid lateral side for swingably interconnecting the pair of symmetrical frame; a middle leg connected to the pivoting bracket; clip wires and tension springs connected from the middle leg to the outside lateral sides for holding the pair of symmetrical frames in an unfolded position; and, a support structure attached on each outside lateral side, a first support structure forming a combination head board and leg, and a second support structure forming a combination foot board and leg. One-piece pertains to the mattress and the bed frame constructed together and not in separate pieces.

The folding bed folds outward and when in a folded position, the undersides of the pair of symmetrical frames face each other. The folded bed stands upright using as base, the support structures on the outside lateral sides of the symmetrical frames which are coplanar when the bed is fully folded. Side rails, preferably attached to the frames, also serve as handles in the folding and unfolding of the bed.

DETAILED DESCRIPTION OF THE INVENTION

Figure 1:
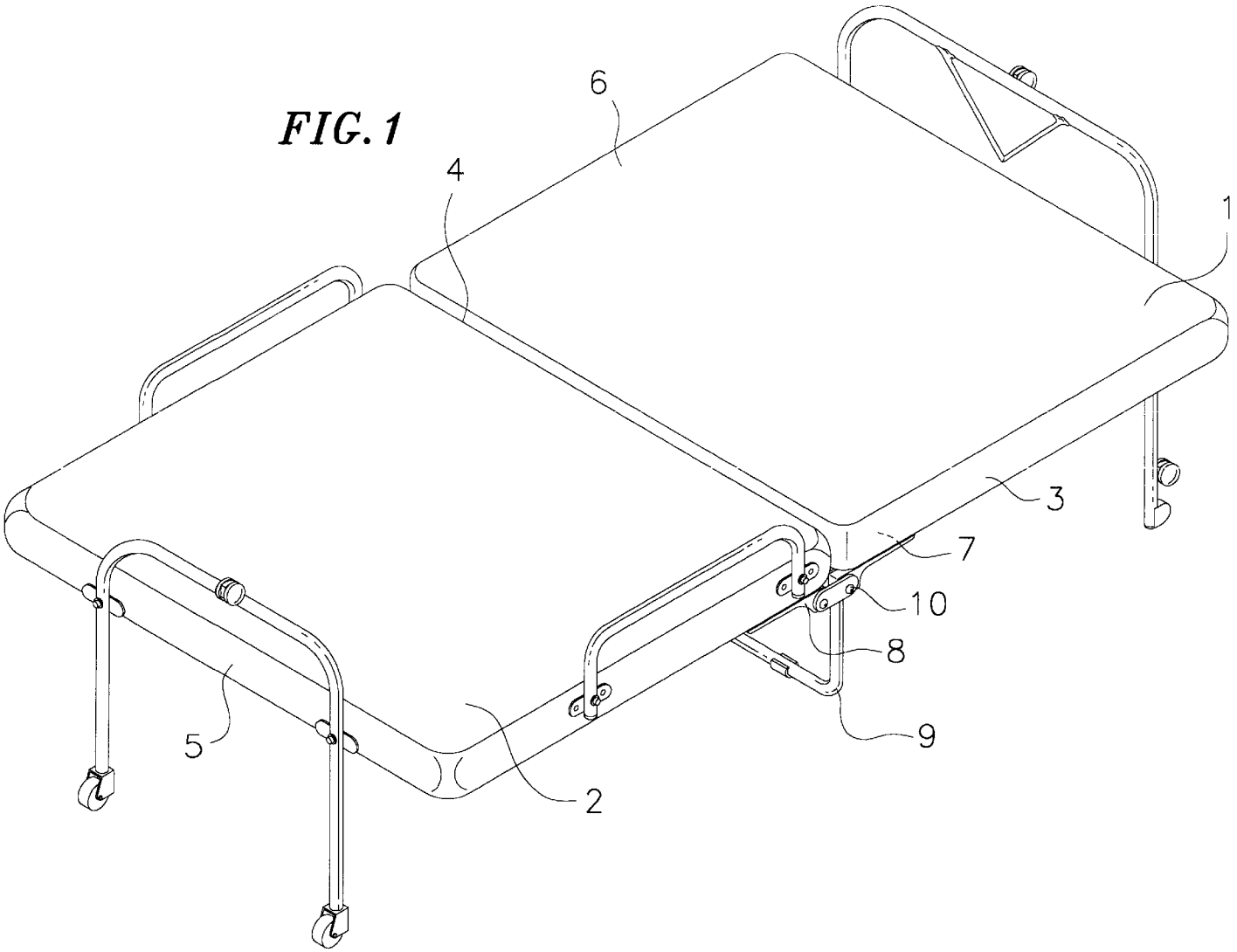
FIG. 1 is a perspective view of the folding bed in an unfolded position.
Figure 2:
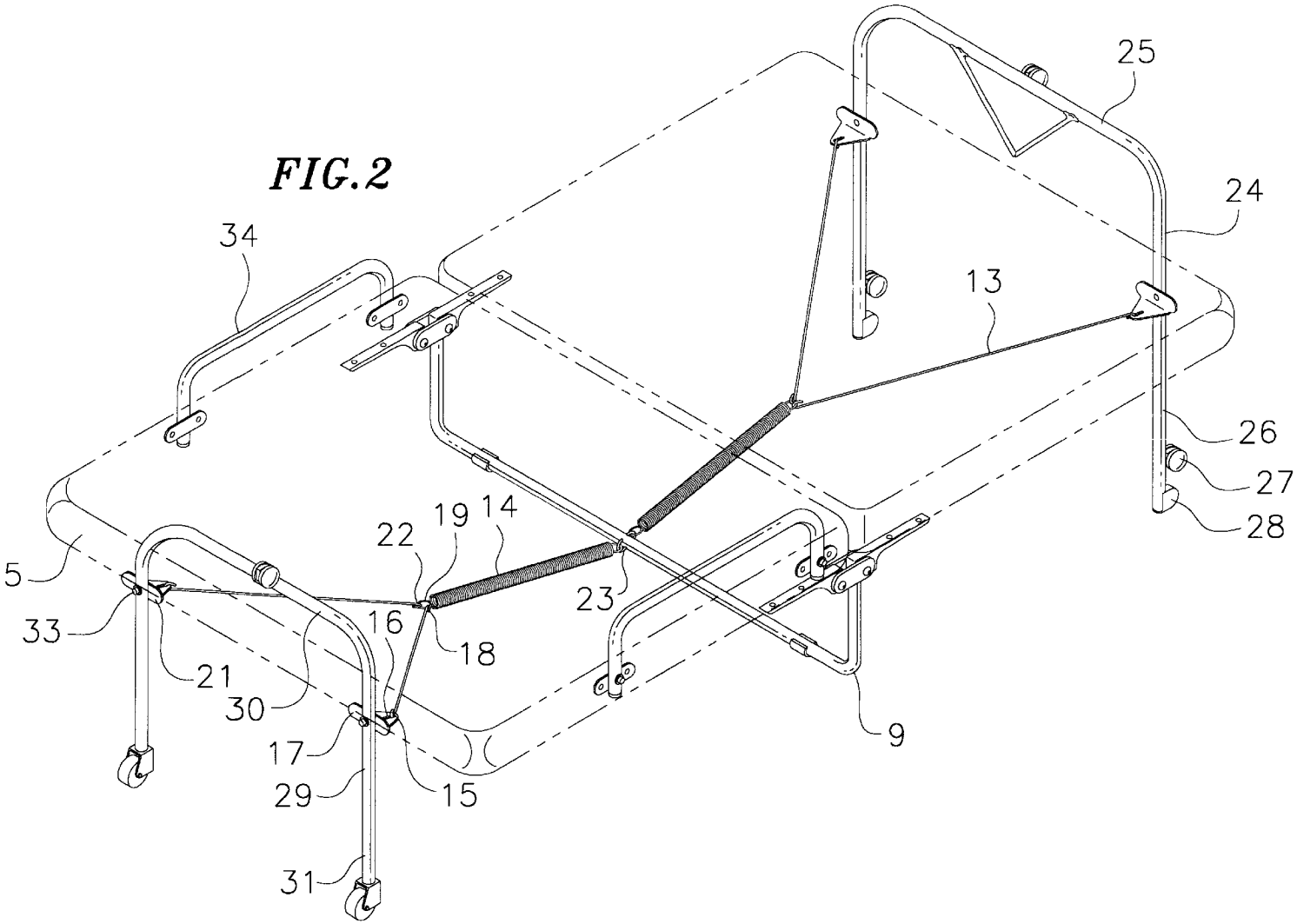
FIG. 2 is a perspective view of the bed in an unfolded position showing the assembly of the parts making up the bed.
Figure 4:
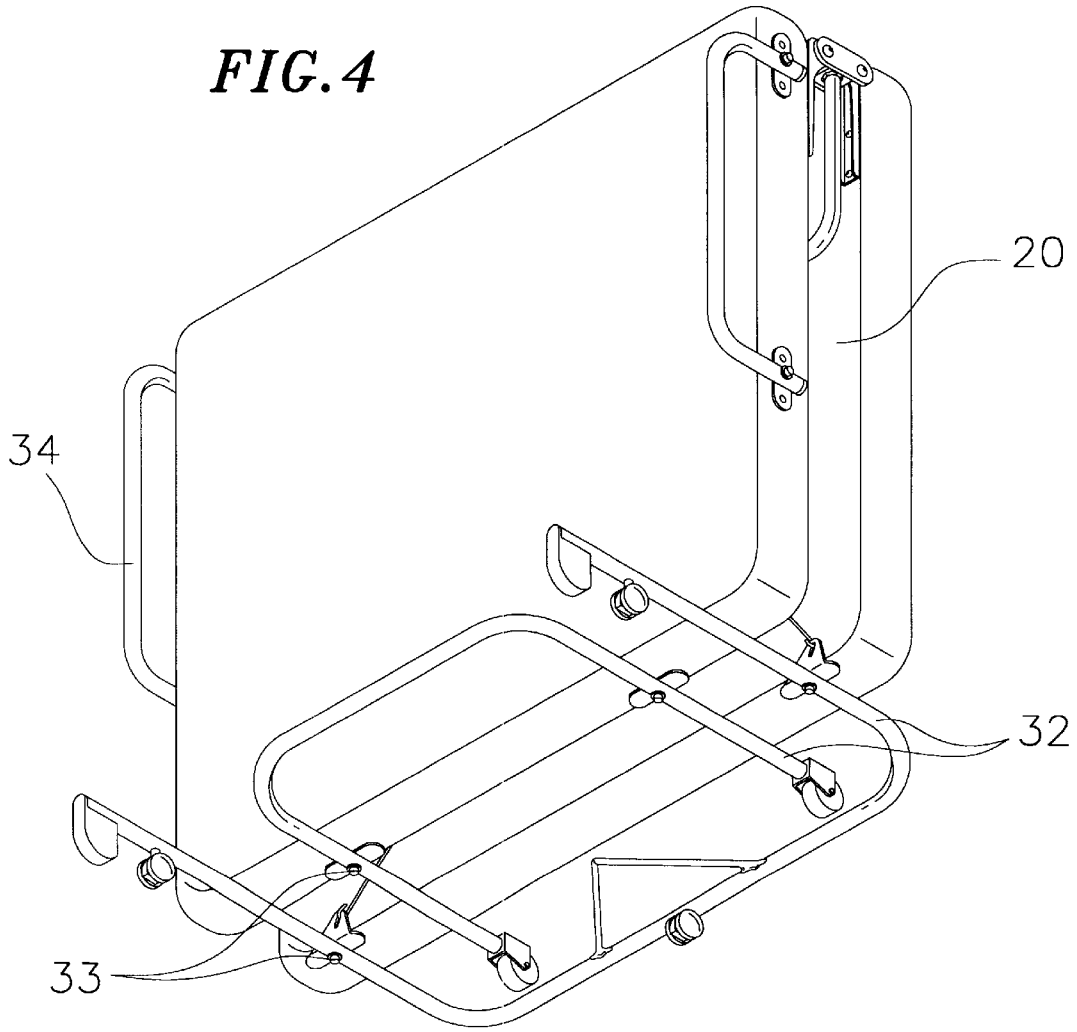
FIG. 4 is a perspective view of the folded bed in an upright position with the bottom detail exposed.

The folding bed of this invention is shown in its unfolded position in FIGS. 1 and 2 in its folded position in FIG. 4.

The folding bed comprise of a pair of symmetrical frames 1 and 2, each frame having two longitudinal sides 3, two lateral sides, a mid lateral side 4 and an outside lateral side 5. The frames are preferably rectangular in shape. In the construction of each frame, a base support element (not shown), preferably made of metal, wood or strong durable plastic, is covered or wrapped around with a filling material, preferably foam, and then inserted into a casing made of synthetic or natural fabric or leather to form the mattress 6 of the bed. Other filling material such as latex, cotton, kapok, natural fibers, feathers and the like known in the art may be substituted for the foam material. The encased frame with filling material is also referred to herein as bed frame. The pair of bed frames in turn serves as the mattress of the folding bed. The casing is of the same geometric shape as the frame which, with its fillers, snug fit into the casing. The amount and kind of filling material used to cover the base support element depend upon the desired thickness and softness of the resulting mattress.

Figure 3:
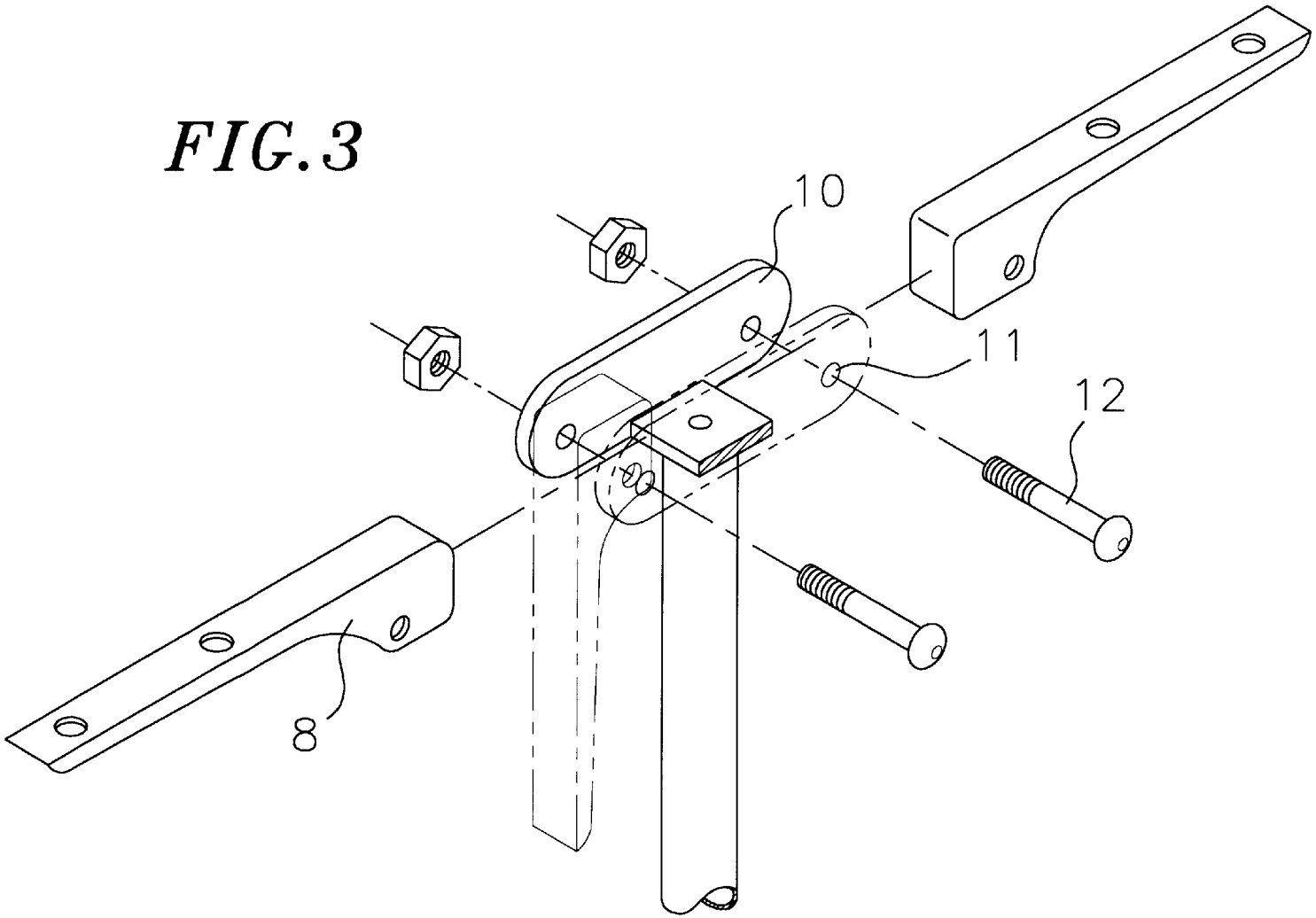
FIG. 3 is a perspective exploded view of the pivoting bracket assembly for interconnecting the pair of symmetrical frame.

The pair of symmetrical frames are interconnected by attaching two longitudinal undersides 7 of each frame, located proximate to the opposite ends of the mid lateral side or section 4, to a pivoting bracket 8 which is connected to a flanged end portion 10 of the middle leg 9, the flanged end portion 10 having an aperture 11 on each end that receive an attachment means 12, an assembly pin, bolt or screw, running through the flanged end portion 10 and the pivoting bracket 8 to provide pivotal interconnection. This pivoting bracket assembly is shown in FIG. 3. The folding bed folds outward with the undersides of the pair of symmetrical frames facing each other. The distance between one attachment means 12 on one end of the flanged end portion 10 to the other attachment means on the other end of the same flanged end portion and the width of the flanged end portion 10 dictates the gap 20 between the pair of symmetrical bed frames when the folding bed is in the full folded position. The desired space or gap between the two symmetrical bed frame varies according to the thickness of the frame. For example, this gap is preferably three inches when the thickness of the bed frame is approximately three inches such that when the frames are unfolded, there will be no gap between the two symmetrical bed frames. The pair of symmetrical bed frames are further held by clips 13 and tension springs 14 as shown in FIG. 2. Referring to one bed frame, a first end hook 15 of a clip is catched to an aperture 16 of a bolting bracket 17 located on one end of the outside lateral side 5 and the second end hook 18 of the same clip is catched to the first ring 19 end of a tension spring 14. A second clip is catched in the same manner to another bolting bracket 21 located at the other end of the outside lateral side 5 but the end hook 22 of the second clip is catched to the same ring 19 of the tension spring 14 forming a v-shaped connection. The second ring end 23 of tension spring 14 opposite the first ring end 19 is hooked to the mid section of the middle leg 9. The other bed frame is similarly connected to its own clips and spring. The middle leg 9 is preferably shaped as a halfrectangle and folds between the undersides of the pair of bed frames when the bed is in a folded position. This leg 9 extends downward, touching the ground or floor when the bed is in the unfolded position. A rubber bumper is preferably clasped or snapped on the surface of the leg 9 touching the floor or ground to protect the floor and leg 9 from getting scratched and also to provide additional traction.

The bolting brackets 17 and 21 on each outside lateral side of the folding bed are also used to attach or bolt a first support structure 24 to the bed frame forming a combination head board and leg. Part of the support structure protruding over the upper surface of the bed frames when in an unfolded position is the head board 25 and the part protruding underneath the bed frames are the legs 26. At each end of the leg 26 are casters 27 for rolling the bed and end caps 28 to cover the sharp edge of the support structure. An additional caster at the middle top portion of the head board is preferred. A second support structure 29 on the other outside lateral end 5 is similarly attached to the bed frame forming a combination foot board 30 and legs 31. At each end of legs 31 is a roller or straight wheel. The legs 31 of the second structure do not extend as far apart from each other as the legs 26 of the first support structure to enable legs 31 to slide into legs 26, thereby forming a stable base 32 to hold the folding bed in a folded upright position as shown in FIG. 4. The first and second support structures can be easily detached from the pair of symmetrical frames and the remaining assembled parts of the folding bed by simply releasing the attaching means 33 from the bolting brackets on each frame which are permanently attached to the bed frame. Because the distance between the bolting brackets on each outside lateral side of the folding bed or bed frame is different, assembly is likewise facilitated by simply matching the support structure that fits the bolting brackets. Examples of attaching means are bolts, pins, screws, studs and the like. Side rails 34 may also be bolted on the folding bed which can be used as handles to facilitate the folding and unfolding of the bed. The ends of the side rails are preferably capped with plastic or rubber end caps to prevent exposure of the interior to outside environmental factors and also prevent the user from being scratched by the metal edges.

While the embodiment of the present invention have been described, it should be understood that various changes, adaptations, and modifications may be made therein without departing from the spirit of the invention and the scope of the claims.

I claim:

1. A compact folding bed, comprising:

a pair of symmetrical frames, each frame having two longitudinal sides, two lateral sides, a mid lateral side and an outside lateral side, a top surface, an underside, a base support element, the pair of symmetrical frames covered with filling material encased in fabric or leather material forming a mattress;

pivoting brackets located at opposite ends of the mid lateral side for swingably interconnecting the pair of symmetrical frame;

a middle leg connected to the pivoting bracket;

clip wires each having a first end hook and a second end hook, the first end hook catched to an aperture of a bolting bracket located on one end of the outside lateral side of a bed frame and the second hook of the same clip catched to a ring end of a tension spring forming a v-shaped connection, the tension spring connected from the middle leg to the outside lateral sides for holding the pair of symmetrical frames in an unfolded position; and, a support structure attached on each outside lateral side, a first support structure forming a combination head board and leg, and a second support structure forming a combination foot board and leg.

2. The compact folding bed of claim 1 wherein the folding bed folds outward with the undersides of the pair of symmetrical frame facing each other.

3. The compact folding bed of claim 1 wherein the leg of the second support structures slide into the leg of the first structure forming a stable base for holding the folding bed in an upright position.

4. The compact folding bed of claim 1 further comprising rolling means at each end of the leg and at a middle top portion of the head board of the first support structure and at each end of the leg and at a middle top portion of the foot board of the second support structure.

5. The compact folding bed of claim 1 wherein the first and second support structures are detachable from the pair of symmetrical frames of the folding bed.

6. The compact folding bed of claim 1 further comprising side rails as handles for facilitating the folding and unfolding of the bed.

7. The compact folding bed of claim 1 wherein each pivoting bracket is attached to a longitudinal underside of a bed frame located proximate to opposite ends of the mid lateral sides of the folding bed.

8. The compact folding bed of claim 1 wherein the pivoting bracket is connected to a flanged end portion of the middle leg having apertures for receiving an attaching means running through the flanged end portion and the pivoting bracket for pivotal interconnection.

9. The compact folding bed of claim 8 wherein the pivotal interconnection provided by the flanged end portion of the middle leg and the pivoting bracket form a gap between the pair of symmetrical frames when the folding bed is in a full folded position.

10. The compact folding bed of claim 1 wherein the tension spring on each frame has two ends, a first ring end and an opposite second ring end, the second ring end attaching at a mid section of the middle leg and the opposite first ring end attaching to the two clip wires.

11. The compact folding bed of claim 1 wherein the middle leg is shaped as a halfrectangle folding between the undersides of the pair of symmetrical frames when the bed is in a folded position and extending downward when the pair of symmetrical frames is in the unfolded position.

12. The compact folding bed of claim 1 wherein the base support element is made of metal, wood or strong durable plastic.

13. A compact folding bed, comprising:

a pair of symmetrical frames folding outward with undersides of the pair of symmetrical frame facing each other, each frame having two longitudinal sides, two lateral sides, a mid lateral side and an outside lateral side, a top surface, an underside, a base support element, the pair of symmetrical frames made of metal, wood or strong durable plastic covered with filling material encased in fabric or leather material forming a mattress;

pivoting brackets located at opposite ends of the mid lateral side for swingably interconnecting the pair of symmetrical frame;

a middle leg connected to the pivoting bracket;

clip wires and tension springs connected from the middle leg to the outside lateral sides for holding the pair of symmetrical frames in an unfolded position, each clip wire having a first end hook and a second end hook, the first end hook catched to an aperture of a bolting bracket located on one end of the outside lateral side of a bed frame and the second end hook of the same clip catched to a ring end of the tension spring forming a v-shaped connection, the tension springs having two ends, a first ring end and an opposite second ring end, the second ring end attaching at a mid section of the middle leg and the opposite first ring end attaching to the two clip wires; and, a support structure attached on each outside lateral side, a first support structure forming a combination head board and leg, and a second support structure forming a combination foot board and leg, the leg of the second support structures slideable into the leg of the first structure forming a stable base for holding the folding bed in an upright position.

14. The compact folding bed of claim 13 further comprising rolling means at each end of the leg and at a middle top portion of the head board of the first support structure and at each end of the leg and at a middle top portion of the foot board of the second support structure.

15. The compact folding bed of claim 13 wherein the first and second support structures are detachable from the pair of symmetrical frames of the folding bed.

16. The compact folding bed of claim 13 further comprising side rails as handles for facilitating the folding and unfolding of the bed.

17. The compact folding bed of claim 13 wherein each pivoting bracket is attached to a longitudinal underside of a bed frame located proximate to opposite ends of the mid lateral sides of the folding bed.

18. The compact folding bed of claim 13 wherein the pivoting bracket is connected to a flanged end portion of the middle leg having apertures for receiving an attaching means running through the flanged end portion and the pivoting bracket for pivotal interconnection.

19. The compact folding bed of claim 13 wherein the pivotal interconnection provided by the flanged end portion of the middle leg and the pivoting bracket form a gap between the pair of symmetrical frames when the folding bed is in a full folded position.

* * * * *